US007332035B1

(12) United States Patent
Tudor et al.

(10) Patent No.: US 7,332,035 B1
(45) Date of Patent: Feb. 19, 2008

(54) MULTIPLE ORIFICE APPLICATOR WITH IMPROVED SEALING

(75) Inventors: Thomas Tudor, Westland, MI (US); Scott Taylor, Westland, MI (US); Nick Schultz, Plymouth, MI (US)

(73) Assignee: Sealant Equipment & Engineering, Inc., Plymouth, MI (US)

( * ) Notice: Subject to any disclaimer, the term of this patent is extended or adjusted under 35 U.S.C. 154(b) by 0 days.

(21) Appl. No.: 10/709,119

(22) Filed: Apr. 14, 2004

Related U.S. Application Data

(63) Continuation-in-part of application No. 10/336,943, filed on Jan. 6, 2003, and a continuation-in-part of application No. 09/990,607, filed on Nov. 21, 2001, now Pat. No. 6,695,923.

(60) Provisional application No. 60/253,070, filed on Nov. 21, 2000.

(51) Int. Cl.
*B05C 5/00* (2006.01)

(52) U.S. Cl. ..... 118/315; 118/323

(58) Field of Classification Search ..... 239/591, 239/DIG. 19, DIG. 4, 556, 557, 583, 135; 118/411, 315, 679, 681, 686, 666, 669, 712, 118/325, 419, 302
See application file for complete search history.

(56) References Cited

U.S. PATENT DOCUMENTS

| | | | | |
|---|---|---|---|---|
| 3,259,938 | A * | 7/1966 | Martin | 425/464 |
| 3,480,706 | A | 11/1969 | Carpenter et al. | |
| 3,602,193 | A | 8/1971 | Adams et al. | |
| 4,247,497 | A * | 1/1981 | Wolf | 264/40.4 |
| 4,421,722 | A * | 12/1983 | Massey et al. | 422/129 |
| 4,622,239 | A | 11/1986 | Schoenthaler et al. | |
| 4,678,423 | A * | 7/1987 | Bertolotti | 425/311 |
| 4,687,137 | A | 8/1987 | Boger et al. | |
| 4,766,844 | A | 8/1988 | Brewer et al. | |
| 4,938,994 | A | 7/1990 | Choinski | |
| 4,961,955 | A | 10/1990 | Goldberg | |
| 5,002,800 | A * | 3/1991 | Uehara et al. | 427/209 |
| 5,045,358 | A | 9/1991 | Watanabe et al. | |

(Continued)

FOREIGN PATENT DOCUMENTS

WO WO 99/65612 A1 12/1999

OTHER PUBLICATIONS

Nozzletech, Inc. publication entitled "Low Cost Precision Adhesive Nozzles and Accessories", date unknown.

*Primary Examiner*—Brenda A. Lamb
(74) *Attorney, Agent, or Firm*—Rader, Fishman & Grauer PLLC

(57) ABSTRACT

A multiple orifice applicator system for dispensing a plurality of rows of fluid material onto a work piece is disclosed. A source of fluid material is in fluid communication with the multiple orifice applicator. The multiple orifice applicator is mounted to a robotic arm, which positions the multiple orifice applicator relative to the work piece to enable the multiple orifice applicator to dispense fluid material onto the work piece. Fluid material is caused to flow from the source of fluid material into the multiple orifice applicator. The fluid material enters the multiple orifice applicator through an inlet duct and is dispersed and spread out into at least one dispersing chamber. The fluid material is dispensed onto the work piece through a plurality of outlet orifices in the multiple orifice applicator.

15 Claims, 14 Drawing Sheets

U.S. PATENT DOCUMENTS 5,061,170 A * 10/1991 Allen et al. ..... 425/197
5,136,972 A 8/1992 Naka et al.
5,226,963 A 7/1993 Shibata
5,265,800 A * 11/1993 Ziecker et al. ..... 239/1
5,335,825 A 8/1994 Fort
5,344,297 A * 9/1994 Hills ..... 425/131.5
5,421,941 A 6/1995 Allen et al.
5,479,352 A 12/1995 Smith
5,540,774 A 7/1996 Smitherman
5,769,947 A * 6/1998 Krappweis ..... 118/411
5,891,482 A * 4/1999 Choi ..... 425/72.2
5,902,540 A * 5/1999 Kwok ..... 264/555
6,001,425 A * 12/1999 Stash et al. ..... 427/430.1
6,471,774 B1 10/2002 Krueger

* cited by examiner

MULTIPLE ORIFICE APPLICATOR WITH IMPROVED SEALING

CROSS REFERENCE TO RELATED APPLICATIONS

This application claims priority as a Continuation-In-Part to U.S. patent application Ser. No. 10/336,943 filed on Jan. 6, 2003 that is a Continuation-In-Part of U.S. Pat. No. 6,695,923 filed on Nov. 21, 2001, which claims priority to U.S. Provisional Application No. 60/253,070 filed on Nov. 21, 2000; the contents of each are incorporated herein in their entirety.

FIELD OF THE INVENTION

The present invention relates to devices for and methods of dispensing various materials, such as adhesives, epoxies, sealants, and sound dampening materials. More specifically, the present invention relates to a device for and a method of applying a relatively wide band of material to a work piece by applying multiple closely-spaced rows of the material from a multiple orifice applicator.

BACKGROUND OF THE INVENTION

It is common in many industries to apply various fluid materials, such as adhesives, epoxies, sealants, sound deadening materials, structurally-stiffening materials, insulating materials, and the like, using robotically-applied materials supplied from a dispensing system. These fluid materials are commonly applied to a wide variety of items, such as (but not limited to) automotive parts, household appliance parts, conformal coating of electronic circuit boards, medical devices, and construction items (windows, doors, etc.) during manufacture.

One known method of applying fluid materials to a work piece involves extruding the fluid material. Extrusion of fluid material generally involves maintaining an outlet nozzle of an extruding device very close to the work piece and allowing a single bead of fluid material to be applied to the work piece, either as the work piece is moved relative to the nozzle or the nozzle is moved relative to the work piece.

Another known method of applying a fluid material to a work piece is to "stream" the fluid material. "Streaming" is a relatively high-speed application process wherein the fluid material is dispensed from a nozzle under relatively high pressure and from a relatively greater distance from the work piece as compared to methods where the fluid material is extruded onto the work piece. Generally, a work piece is set in position—either robotically, via a conveyor system, or manually—and a fluid dispensing nozzle mounted to the end of a robot arm is caused to make one or more "passes" over the work piece, dispensing fluid material during each pass. Known systems for streaming fluid materials, such as that disclosed in U.S. Pat. No. 5,979,794 to DeFillipi et al., include a nozzle having a single outlet orifice for dispensing a single stream of fluid material. As a result, each pass of the dispensing mechanism over the work piece produces a single bead of fluid material that is approximately the width of the outlet orifice opening of the nozzle.

Many situations require the application of relatively wide bands, i.e., several inches wide, of fluid material to a work piece. By way of example only, various automotive sound dampening applications require the application of wide bands of sound dampening material or panel-stiffening material to a vehicle door, body panel or frame assembly.

Because the outlet orifice of a streaming nozzle must maintain a relatively small diameter (to maintain the required fluid pressure to stream the material), it is not possible to stream wide bands of fluid materials onto a work piece during a single pass of the robot arm using known methods and systems for fluid streaming. Accordingly, for situations requiring wide bands of fluid materials, various application methods have been used.

One known method is to cause the application nozzle to make several passes over the work piece, thereby applying several beads or streams of fluid material adjacent each other. This method suffers from several disadvantages. First, because this method typically requires many passes by the application nozzle, the manufacturing process is slowed to accommodate the amount of time required to physically move the nozzle back and forth over the work piece until the entire band is applied. Second, it has been found to be difficult to create a continuous band of material using this method because it is difficult to ensure that adjacently-applied beads are the same thickness and that they are applied precisely adjacent to each other. Third, the automation tooling experiences additional wear and tear due to the additional motion required in making multiple passes over the work piece. Fourth, it is more complicated and less efficient to program equipment to make multiple passes over the work piece instead of a single pass. Further, because fluid materials being applied to the work piece tend to "set up" relatively quickly, a previously-applied bead may not blend together with a subsequently-applied bead particularly well, thus resulting in distinct beads of material instead of a continuous band of material on the work piece.

Another known method of applying fluid material to create a relatively wide band on a work piece is known as "swirling." Swirling application systems include a single orifice nozzle that can be programmed to rotate in a circular motion. The rotating nozzle creates a circular pattern of fluid material on the work piece. As the nozzle is moved longitudinally across the work piece, the adjacent circles of material blend together to create a material band having a width equal to the diameter of the circles. Swirling systems suffer from some of the same disadvantages as described above. Further, the swirling method is sometimes imprecise, whereby "overspray" is caused as a result of the circular motion of the nozzle. Also, the width of the band of fluid material that can be created using the swirling method is relatively limited, which may result in the need for multiple passes over the work piece to achieve a desired band width. Finally, the rotating nozzle of a swirling device is actuated by a motor and other moving mechanical parts, which require significant maintenance. As a result of several of these drawbacks, the swirling method is a relatively expensive process.

Yet another known method for applying fluid material to create a wide band of material on a work piece is known as the "slot nozzle" method. The slot nozzle method involves applying fluid material using a nozzle having a single elongated orifice in the shape of a slot. While the slot nozzle method may be useful for applying wide bands of material, it has been found difficult to maintain a consistent thickness across the band of material when using a slot nozzle. The fluid material tends to accumulate closer to the middle of the band, thereby creating a band that is thicker in the middle and thinner near the edges. Further, because slot nozzles have a large continuous outlet opening, it is difficult to create sufficient fluid pressure in the system to dispense the material onto the work piece. Finally, the large outlet opening tends to allow a certain amount of fluid dripping for a period of time after the flow of fluid material is stopped.

Yet another known method for applying fluid material to create a wide band of material on a work piece is known as the "spraying" method. The spraying method involves applying fluid material using a spray nozzle having a single small orifice specifically designed to atomize the fluid material. This method suffers from several disadvantages. First, while the spraying method may be useful for applying wide bands of material, it is difficult to maintain a consistent thickness across the band of material using this method. Second, it is difficult to control the overspray created by this method. Third, the spray nozzle experiences excessive wear in a relatively short period of time as a result of the large volume of material that passes through a single spray nozzle orifice. Finally, the sprayed material particles can become airborne and contaminate Class A paint surfaces.

Perhaps as a result of the limitations associated with applying fluid materials to a work piece, the standard method of applying certain materials does not involve applying a fluid material at all. For example, it is common to apply sound deadening materials and body-stiffening materials to automotive vehicle assembly such as door panels in the form of pre-die-cut melt pads. These pads are designed to be manually applied "stuck" to a vehicle body part or door panel, and then, during a subsequent "bake" stage of the manufacturing process, the high heat causes the melt pads to melt and permanently bond to the desired work surface. The use of pre-cut melt pads is undesirable because it is very labor intensive and also necessary to maintain an inventory of special melt pads in a variety of shapes and sizes. Maintaining an inventory of several different parts is difficult and this entire method is expensive. Further, any melt pads that are unused (because of body style changes, for example) become waste.

The inventors hereof have recognized that it would be desirable to have a device and method to facilitate the application of applying various fluid materials onto a work piece in a relatively wide band and generating a variety of shapes and patterns. Further, the inventors have recognized that it would be desirable to have a device and method that would avoid the use of pre-cut melt pads.

SUMMARY OF THE INVENTION

The present invention relates to a multiple orifice applicator system for applying multiple beads, streams, or ribbons of fluid material onto a work piece in a single pass of the applicator. One particularly useful application of the invention is to create a relatively wide band of material on the work piece in a single pass. The system can also be used to apply several distinct rows of fluid material on a work piece in a single pass. The inventive system includes a source of fluid material in fluid communication with a multiple orifice applicator device and a mechanism for causing relative movement between the multiple orifice applicator and the work piece. The multiple orifice applicator has an inlet port for receiving fluid material, which opens into a fluid dispersing chamber, such as a manifold, wherein the incoming fluid material is allowed to disperse and spread out. The fluid material is forced from the dispersing chamber through a plurality of outlet orifices, which are positioned adjacent to each other. In certain embodiments, the orifices of the applicator are configured in staggered lines such that rows of materials dispensed there from overlap each other without sacrificing structural integrity of the applicator. As a result, fluid material is simultaneously dispensed through multiple adjacent outlet orifices onto the work piece during a single pass. The multiple adjacent beads, ribbons, or streams of material can be dispensed so that they blend or merge with each other on the work piece to create a continuous, uniform band or pattern of fluid material, if desirable. Alternatively, the invention can be used to apply multiple distinct non-merged lines of fluid material on a work piece in a single pass.

In another embodiment of the present invention, the multiple orifice applicator includes an inlet duct and at least two dispersing chambers in fluid communication with the inlet duct. Each of the dispersing chambers includes a plurality of outlet orifices for dispensing the fluid material onto the work piece. A valve is positioned between the inlet duct and each of the dispersing chambers, and is independently operable to allow the fluid material to flow into a corresponding dispersing chamber. As a result, the fluid material is selectively dispensed through multiple adjacent outlet orifices onto the work piece during a single pass. This embodiment provides flexibility in dispensing the material through only one of the dispersing chambers to maneuver around obstacles, such as bolts or holes, on the work piece as well as to generate complex shapes and patterns of dispensed material without having to change the dispensing applicator. This feature is especially useful when the applicator includes a plurality of dispersing chambers and corresponding valves, which can be selectively controlled to vary the width and spacing of the dispensed material.

In yet another embodiment of the present invention, the multiple orifice applicator includes an applicator body having an inlet duct. At least one dispersing chamber is in fluid communication with the inlet duct. The applicator further includes an applicator plate having a plurality of outlet orifices for dispensing the fluid material onto the work piece. The dispersing chamber is at least partially disposed within the applicator plate such that the outlet orifices are in fluid communication with the inlet duct. As a result, the fluid material is dispensed through the plurality of outlet orifices onto the work piece during a single pass.

DETAILED DESCRIPTION

Figure 1A:
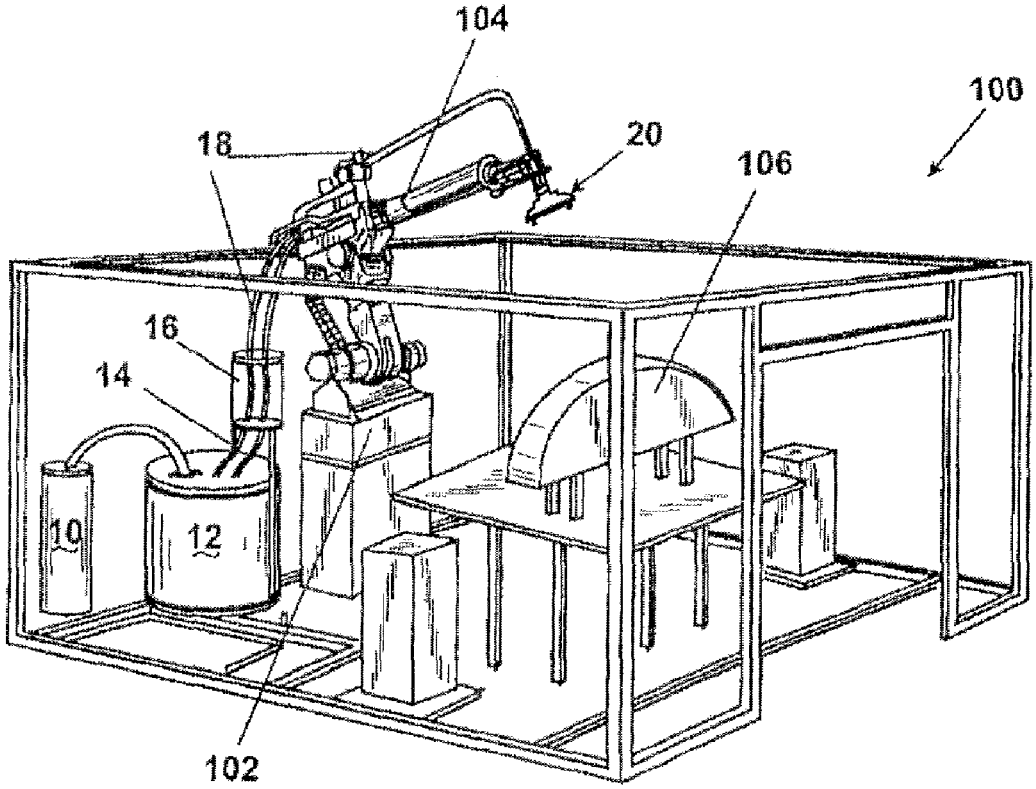
FIG. 1A is a perspective view of an illustrative metering and dispensing system, including the use of a multiple orifice applicator mounted to an articulated robot arm.

Shown in FIG. 1A is an illustrative metering and dispensing system wherein a multiple orifice applicator device of the present invention can be used. A work piece 106 is shown at a particular station of an assembly line function 100. A fluid material is stored in fluid containment vessel 12. A source of air pressure 10 provides pressure to cause the fluid material to flow from containment vessel 12 through a first conduit 14 to a heat exchanger 16, which is used to temperature condition the fluid to maintain its viscosity. The air pressure causes the fluid to flow from the heat exchanger 16 through a second conduit 18 and into multiple orifice applicator head 20. Applicator head 20 is mounted to the end of an articulating arm 104 of an electronically-controlled robot 102, thereby completing the material fluid circuit.

Figure 11:
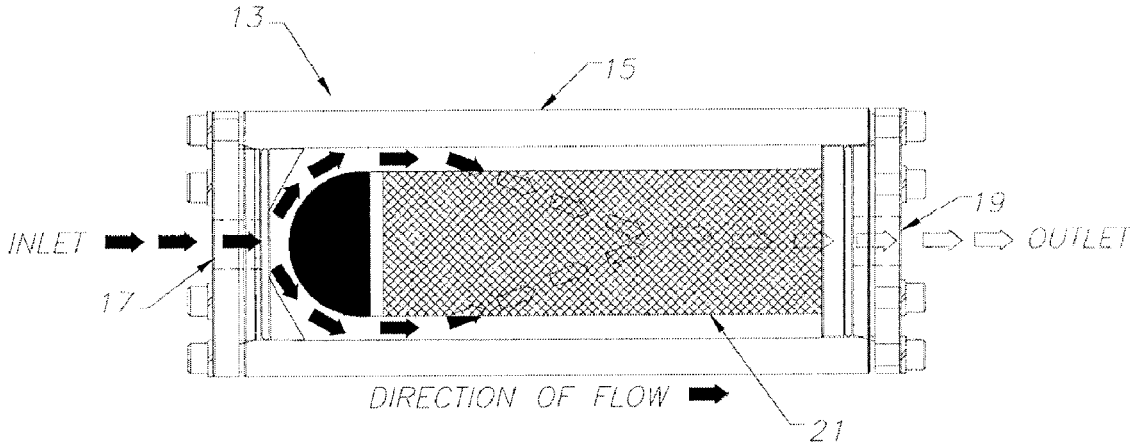
FIG. 11 is a simplified cross-sectional illustration of a filter according to an embodiment of the present invention for use in the dispensing system illustrated in FIG. 1.

Optionally, flow through filter 13 (FIG. 11) may be plumbed in the material fluid circuit—possibility at the outlet of the metering device—to remove undesirable particle matter or other contaminates that could be introduced into the dispense system fluid circuit during bulk supply changes of vessel 12 or general maintenance. Flow through filter 13 has an elongated body 15 having an inlet 17 and outlet 19 at opposing ends of body 15. Filter 13 also includes a spherical material deflecting surface 50 and a filter element 21. The filter element 21 can be made from wire mesh or other suitable materials and is configured to filter out particles of an undesirable size. The opposing relationship between inlet 17 and outlet 19 creates a substantially straight, non-tortuous flow path between inlet 17 and outlet 19. The flow path created by filter 13 forces the fluid material to flow inward from the inside diameter of body 15, around material deflecting surface 50, through filter element 21 and out through outlet 19, as illustrated in FIG. 11.

Figure 10:
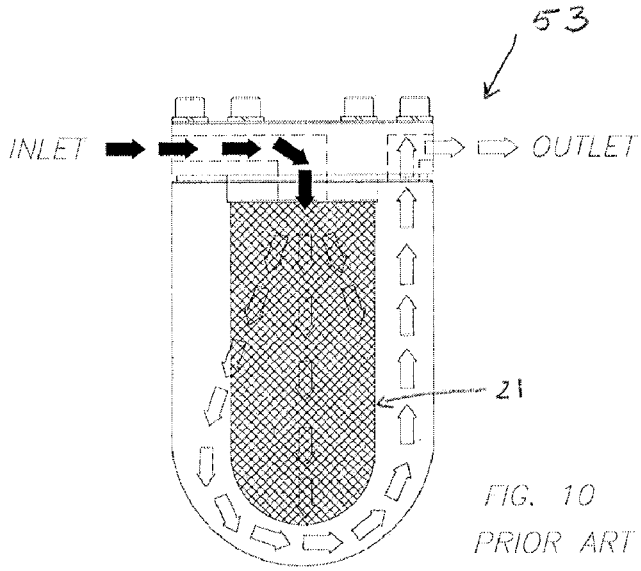
FIG. 10 PRIOR ART
FIG. 10 is a simplified cross-sectional illustration of a prior art "bowl-type" filter.

A flow through filter 13 is preferable to conventional "bowl-type" filters 53 (shown in FIG. 10) because conventional filters 53 include both an inlet and an outlet at the top of the filter, which forces the fluid material to flow into and through the inside diameter of the filter element and then back up the bowl wall to exit the outlet, thus including multiple turns in the fluid path. This tortuous path facilitates dead space in the bottom of the filter where the fluid material fillers or contaminates could collect and pack out. As a result, conventional "bowl-type" filters can result in (i) undesirable material particles collecting down-stream of the filter element 21 where they may clog downstream orifices in the applicator head; (ii) an undesirable separation of fillers from the fluid material due to the multiple turns in the fluid circuit. These problems are overcome by using a flow through filter 13, like that shown in FIG. 11.

The description set forth above of an illustrative metering and dispensing system for the multiple orifice applicator device 20 is not limiting, and the applicator 20 can be used in connection with a wide variety of metering and dispensing systems that dispense fluid materials. Similarly, the applicator 20 could be used in connection with known systems for metering and mixing multiple part fluids, such as two-part epoxies.

Figure 1B:
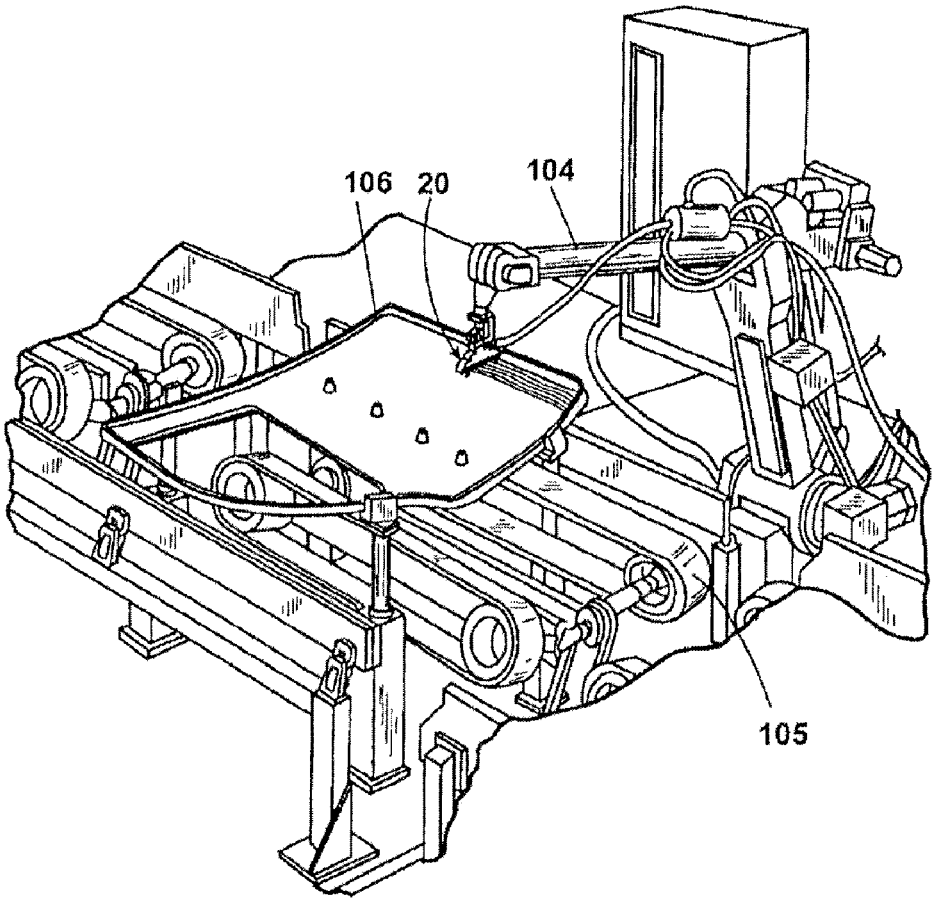
FIG. 1B is a perspective view of an illustrative metering and dispensing system, including the use of a multiple orifice applicator, an articulating robot arm and conveyor assembly line.

Furthermore, while the applicator 20 has been described above as used in connection with an articulating robotic arm, the applicator 20 can also be used in connection with a wide variety of other types of manufacturing environments. For example, FIG. 1B illustrates a multiple orifice applicator 20 being used in connection with an articulating robot 104 and a conveyor belt 105, wherein work pieces 106 are transported under the applicator 20 by the conveyor belt 105. The multiple orifice applicator 20 can also be used with other types of robots, such as SCARA robots, Cartesian robots, XYZ shape generating motion programmable fixtures, or the applicator can be fixed mounted on a fixture and the work piece moved underneath the applicator. In sum, neither the particular meter/mix system used nor the manner in which the work piece is positioned relative to the applicator 20 limits the general use and applicability of the multiple orifice applicator 20.

Figure 2:
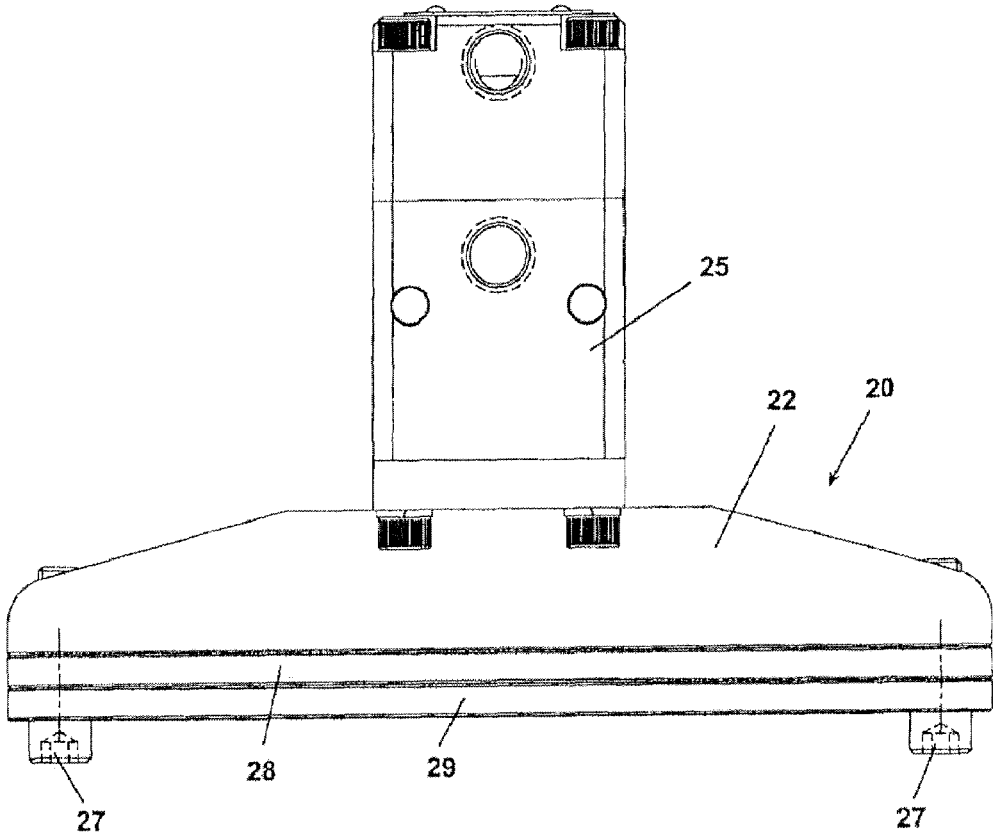
FIG. 2 is a side view of an embodiment of a multiple orifice applicator.

Referring to FIG. 2, the multiple orifice applicator 20 is shown in more detail. Applicator 20 includes an applicator body 22, an integrated valve 25, an applicator plate 28, a retaining plate 29, and bolts 27 that pass through applicator plate 28 and retaining plate 29.

Figure 3:
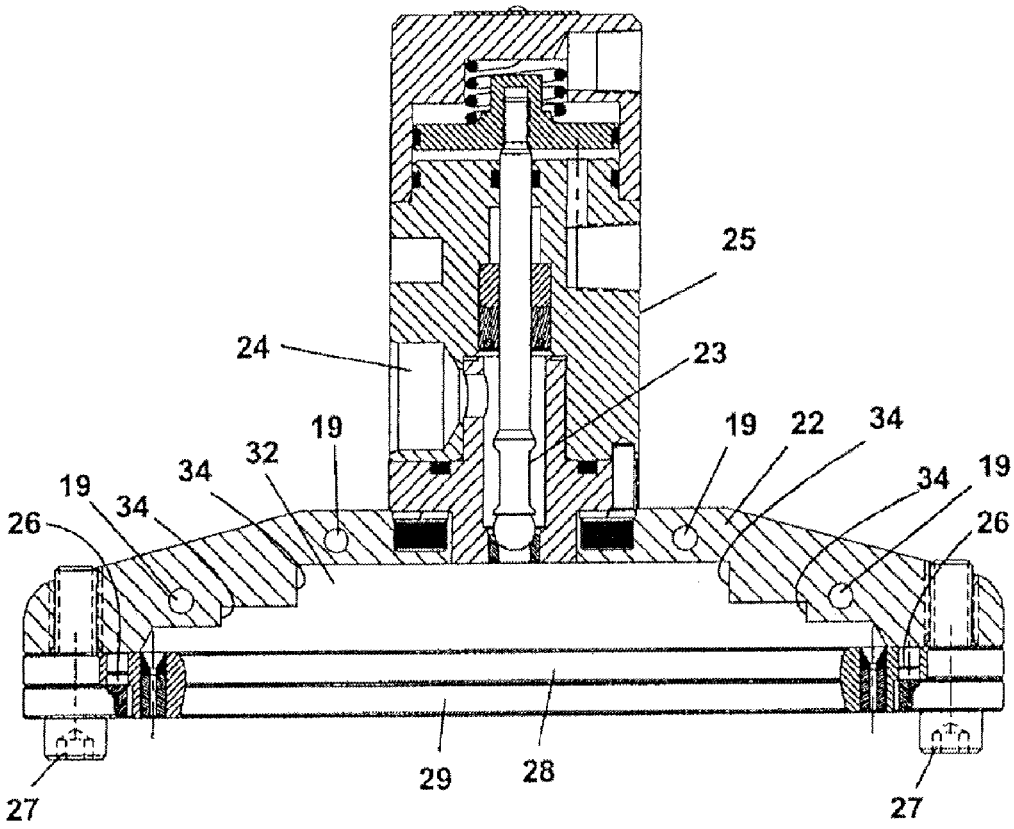
FIG. 3 is a cross-sectional side view of an embodiment of a multiple orifice applicator.

FIG. 3 illustrates a cross-sectional view of the multiple orifice applicator 20, wherein like elements of FIGS. 2 and 3 are identified by like numerals. As shown in FIG. 3, integrated valve 25 includes inlet port 24 through which fluid material from the metering system enters the applicator 20. Applicator body 22 includes a dispersing chamber 32, which is in fluid communication with inlet port 24. Valve actuator 23, which can be selectively opened and closed, is positioned between the inlet port 24 and the dispersing chamber 32. Valve actuator 23 can be controlled by a variety of types of electronic controllers (not shown), such as (but not limited to) a programmable logic controller (PLC) or computer (such as an industrial grade personal computer (PC)). The dispersing chamber 32 preferably includes terraced shoulders 34, which gradually increase the width and volume of the dispersing chamber 32. Locating dowels 26 extend from the bottom of applicator body 22. Locating dowels 26 are adapted to engage with locating holes 40 (shown in FIGS. 4 and 5) in the applicator plate 28 to facilitate easy positioning of the applicator plate 28 relative to the applicator body 22. The applicator body also includes optional temperature-conditioning ports 19. Temperature-conditioning ports 19 are adapted to receive temperature-conditioned liquid—usually water—which temperature-conditions the applicator body 22, which in turn temperature-conditions the fluid material in the dispersing chamber 32. It is sometimes desirable to temperature-condition the fluid material while it is in the applicator 20 to control its viscosity.

Figure 4:
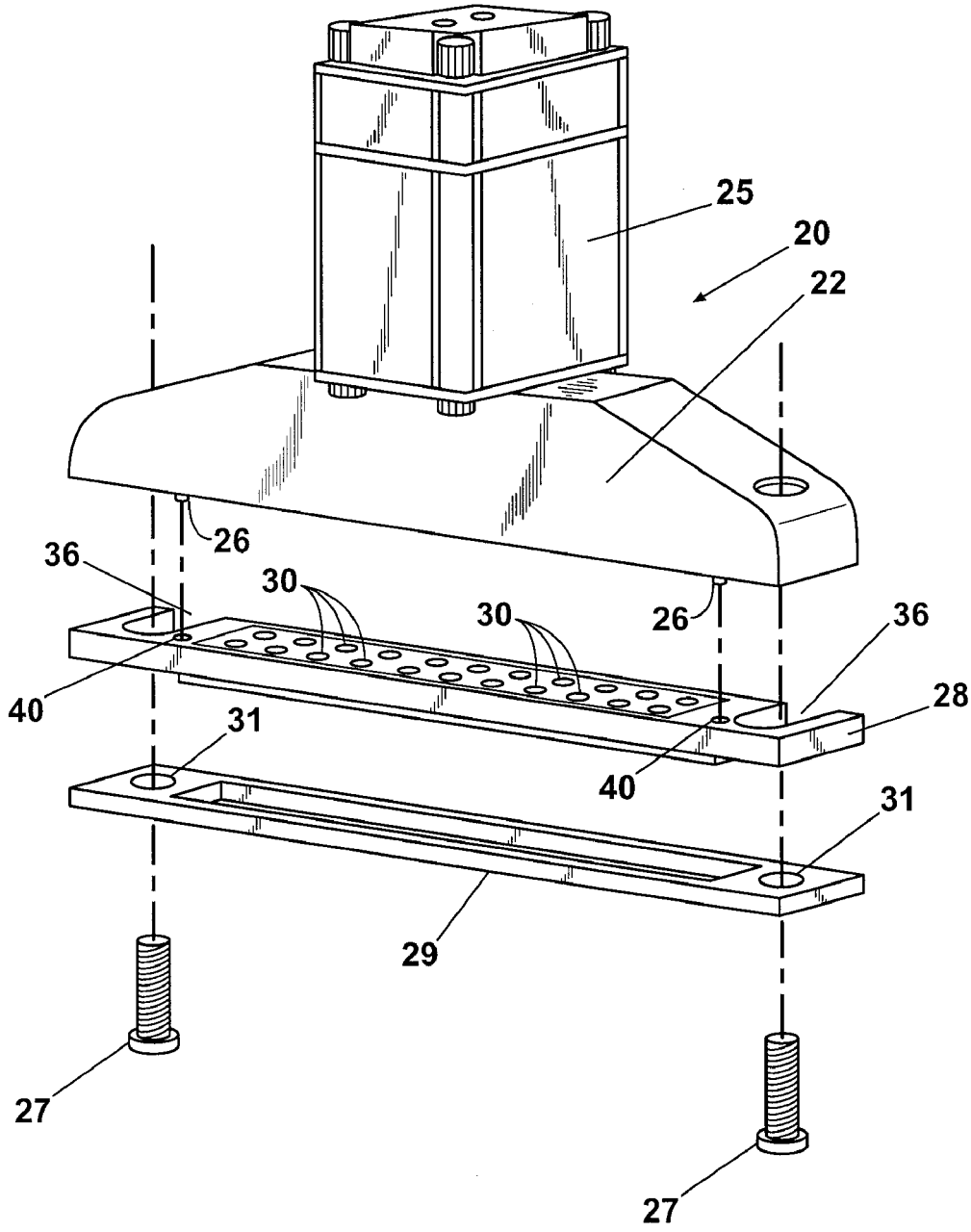
FIG. 4 is a perspective assembly view of an embodiment of a multiple orifice applicator.

FIG. 4 illustrates a perspective assembly view of the multiple orifice applicator 20. As shown in FIG. 4, applicator plate 28 includes a plurality of orifices 30, through which fluid material passing through dispersing chamber 32 is dispensed. When applicator plate 28 is installed onto applicator body 22, locating holes 40 are engaged with locating dowels 26. Then, retaining plate 29 is abutted to applicator plate 28, and bolts 27 are passed through retaining plate holes 31 and applicator plate holes 36, into applicator body 22. In this way, applicator plate 28 is secured to applicator body 22. Preferably, applicator plate holes 36 are open slots on one side. This particular configuration of elements enables the applicator plate 28 to be easily installed and uninstalled without having to stop the manufacturing process for an extended period of time and without having to install or uninstall the entire applicator 20. Changing the applicator plate 28 consists simply of loosing bolts 27 to remove applicator plate 28, installing a new applicator 28, and tightening bolts 27. It is desirable to be able to quickly change applicator plates to accommodate different patterns of outlet orifices 30 for different applications.

Figure 5:
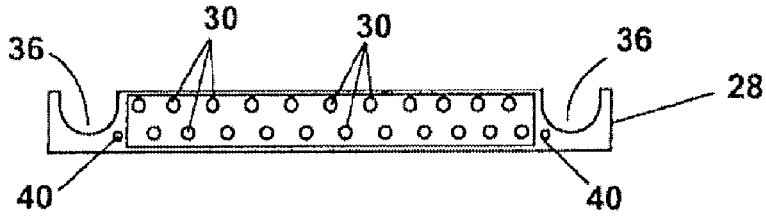
FIG. 5 is a bottom view of a first applicator plate of the multiple orifice applicator shown in FIG. 4.
Figure 6:
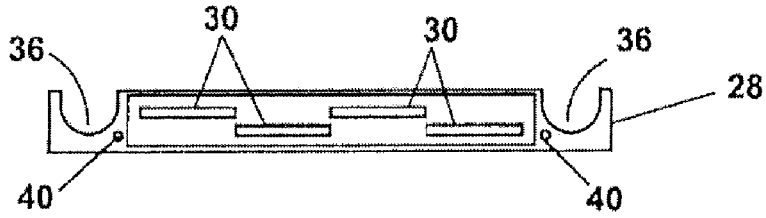
FIG. 6 is a bottom view of a second applicator plate of the multiple orifice applicator shown in FIG. 4.

FIGS. 5 and 6 illustrate bottom views of alternative embodiments of the applicator plate 28. In particular, FIG. 5 illustrates an applicator plate 28 having two rows of round outlet orifices 30, whereas FIG. 6 illustrates an applicator plate 28 having two rows of elongated rectangular outlet orifices 30. Further, many other patterns and shapes of outlet orifices 30 are useful, depending on the particular application, and are within the scope of this invention. While the outlet orifices may be formed simply by machining orifices in the applicator plate 28, it may be desirable to use orifice inserts made from an abrasive-resistant material, such as carbide, depending on the abrasiveness of the fluid material being dispensed. In sum, the number, size and shape of the outlet orifices 30 are determined by the width, distance, viscosity and tool tip speed necessary to form the desired formation of the material, which may or may not include ridges.

Figure 4A:
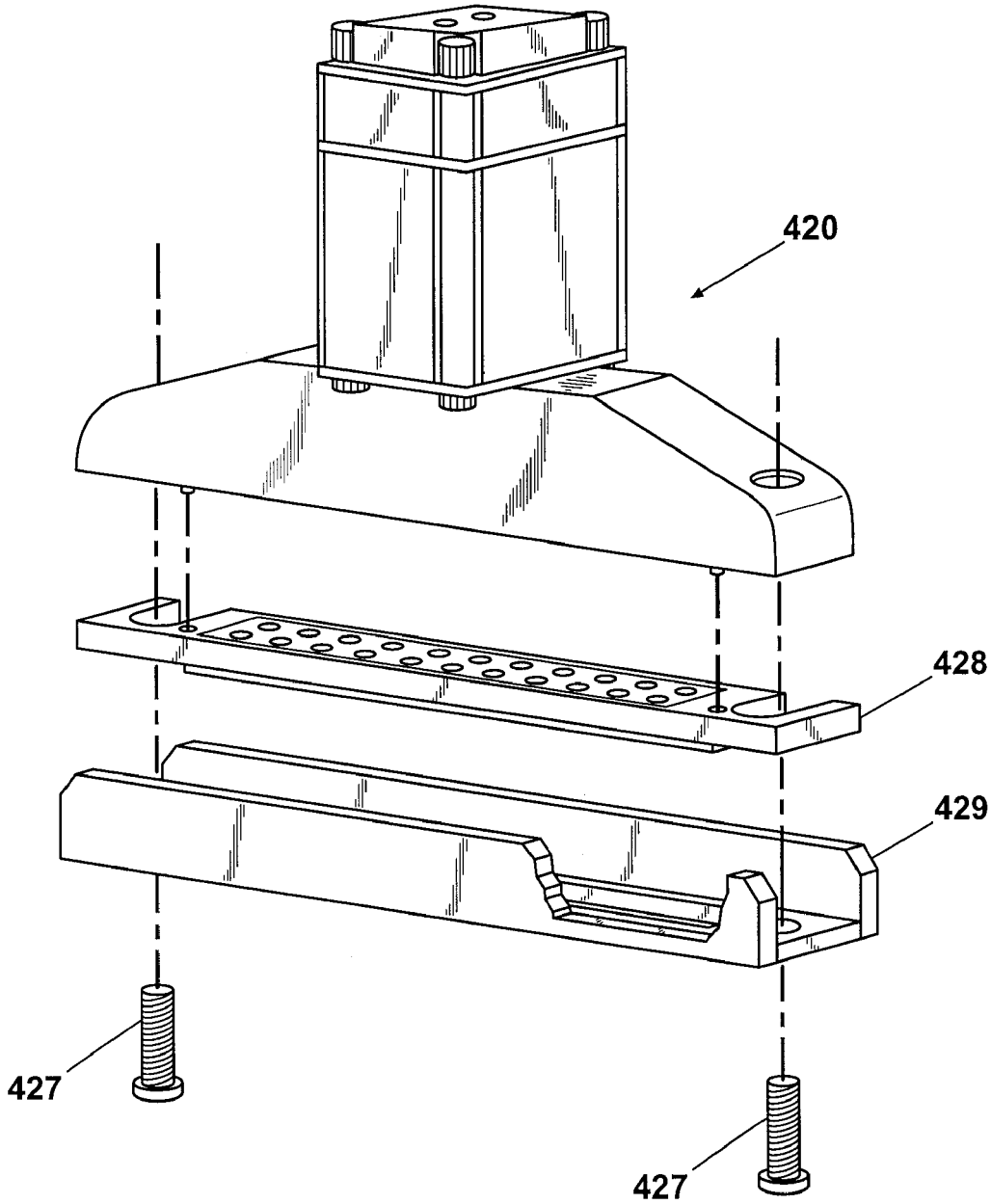
FIG. 4*a* is a perspective assembly view of a second embodiment of a multiple orifice applicator.
Figure 4B:
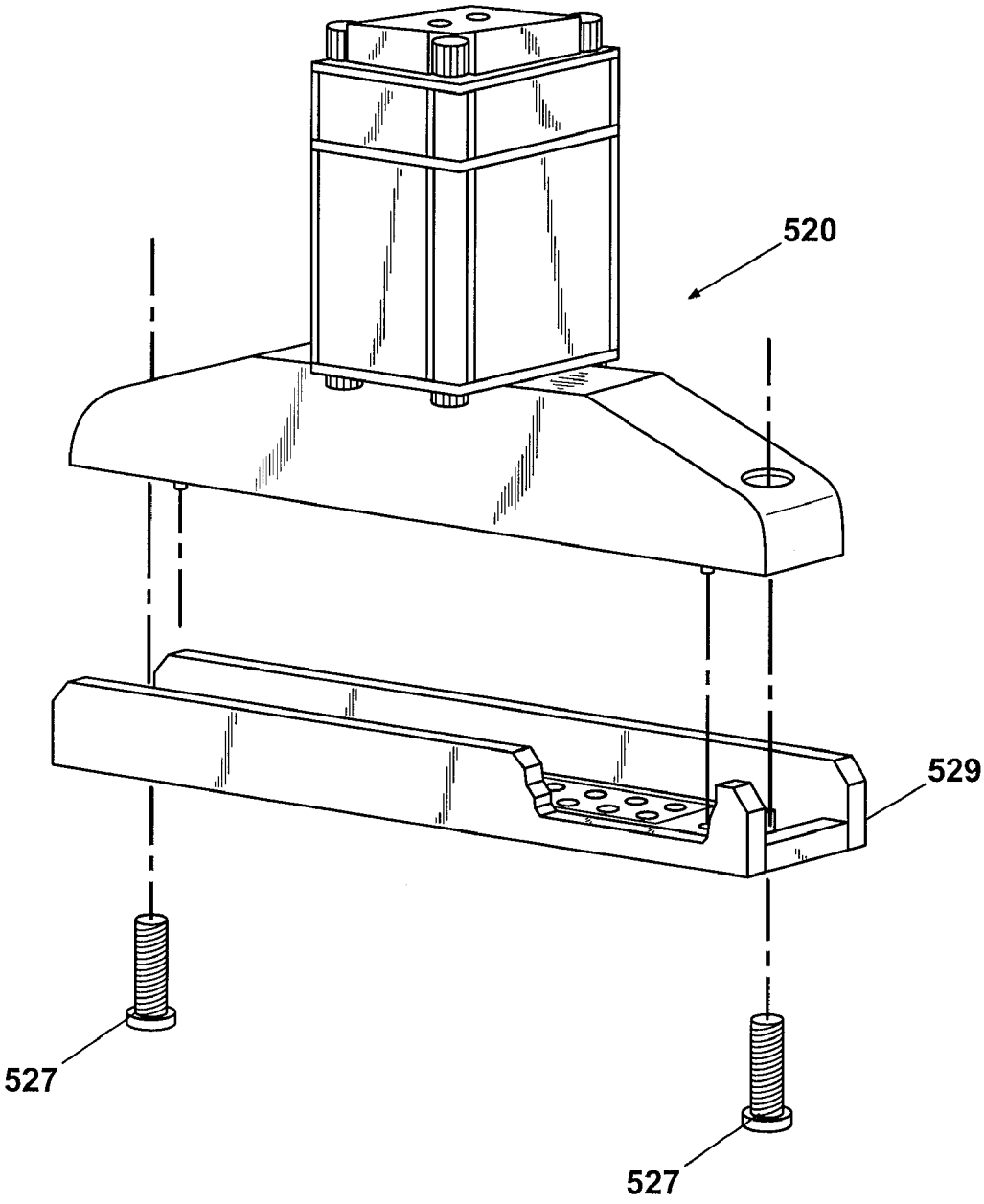
FIG. 4*b* is a perspective assembly view of a third embodiment of a multiple orifice applicator.

FIGS. 4*a* and 4*b* illustrate alternative embodiments of the multiple orifice applicator 20, particularly with respect to the applicator plate and retaining member. Referring first to FIG. 4*a*, the multiple orifice applicator 420 includes an applicator plate 428, a retaining U-Channel member 429 and bolts 427. This embodiment of the multiple orifice applicator 420 is similar to that described above in connection with FIG. 4, except that applicator 420 includes the retaining U-Channel member 429 instead of merely a retaining plate 29. The retaining U-Channel member 429 is configured to secure the applicator plate 428 to the applicator 420 via bolts 427. An advantage of the U-Channel retaining member 429 over the simple retaining plate 29 is increased structural integrity of the device.

Referring now to FIG. 4*b*, multiple orifice applicator 520 includes U-Channel applicator member 529 and bolts 527. The embodiment of applicator 520 is similar to that of applicator 420 (FIG. 4*a*), except that the features of the applicator plate 428 and the U-Channel member 429 in FIG. 4*a* are integrated into a single U-Channel applicator member in FIG. 4*b*. In this way, the multiple orifice applicator 520 is a simpler design, having fewer distinct parts, but does not sacrifice functionality.

When a dispensing system—such as those described in connection with FIGS. 1A and 1B—is used with the multiple orifice applicator 20, fluid material is caused to flow from the dispensing system into the inlet port 24 of the applicator 20. In response to a control signal, the valve actuator 23 of integrated valve 25 opens to permit fluid material to flow into the dispersing chamber 32. The integrated valve 25 is effective to stop the material from dripping from the applicator 20 when the valve is closed. The terraced shoulders 34 of the dispersing chamber 32 allow the flow of fluid material entering the inlet port 24 to disperse and spread out as the fluid material descends in the dispersing chamber 32. When the fluid reaches the bottom of the dispersing chamber 32, the fluid material is dispensed through the plurality of orifices 30 onto the work piece 106 (of FIG. 1A). The shape of positioning of the outlet orifices 30 can be implemented either so that adjacent rows of material blend together to create a continuous band of material 43, shown in FIG. 9, or maintain discrete rows, depending on the application.

Figure 7:
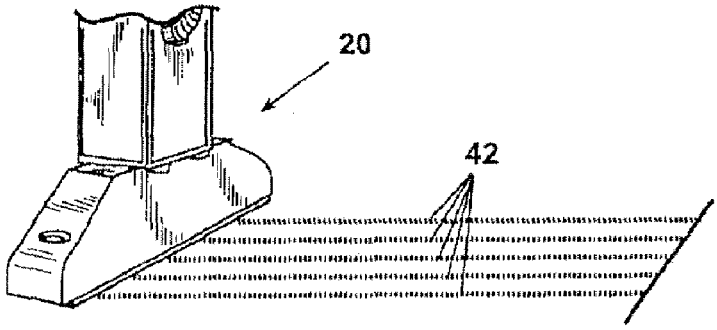
FIG. 7 is a perspective view of a multiple orifice applicator showing application of multiple distinct rows of fluid material.
Figure 8:
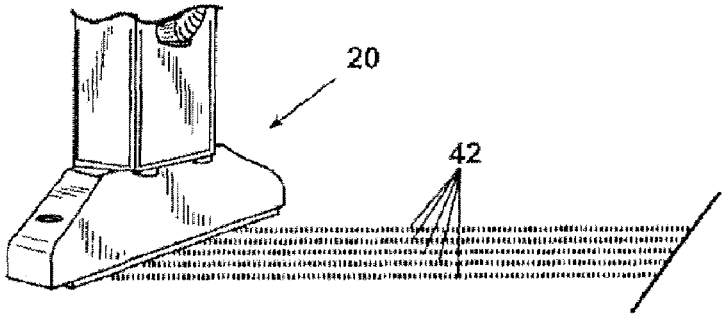
FIG. 8 is a perspective view of a multiple orifice applicator, wherein the applicator is rotated to cause the rows of fluid material to be applied closer together.

Further, as shown in FIGS. 7 and 8, the multiple orifice applicator 20, when used in connection with a robotic arm, can be used in such a manner so as to easily adjust the distance between adjacent rows of fluid material applied to the work piece. FIG. 7 illustrates rows of fluid material 42 applied to a work piece by applicator 20 wherein the work piece is moved directly perpendicular to the applicator 20. In this way, the rows of fluid material on the work piece are spaced the same distance apart as the outlet orifices 30 on the applicator plate 28. If it is desirable to reduce the distance between adjacent rows of fluid material on the work piece, one way of accomplishing this objective is to change the applicator plate 28 to one having outlet orifices 30 that are more closely spaced. Alternatively, and perhaps more efficiently, the multiple orifice applicator 20, using the same applicator plate 28, can be rotated by the robot arm relative to the work piece. Then, as the work piece is moved relative to the applicator 20, the rows of fluid material applied to the work piece are closer together. Depending on the shape and pattern of the outlet orifices 30, a greater rotation of the applicator 20 produces rows of fluid material on the work piece that are closer together.

Figure 13:
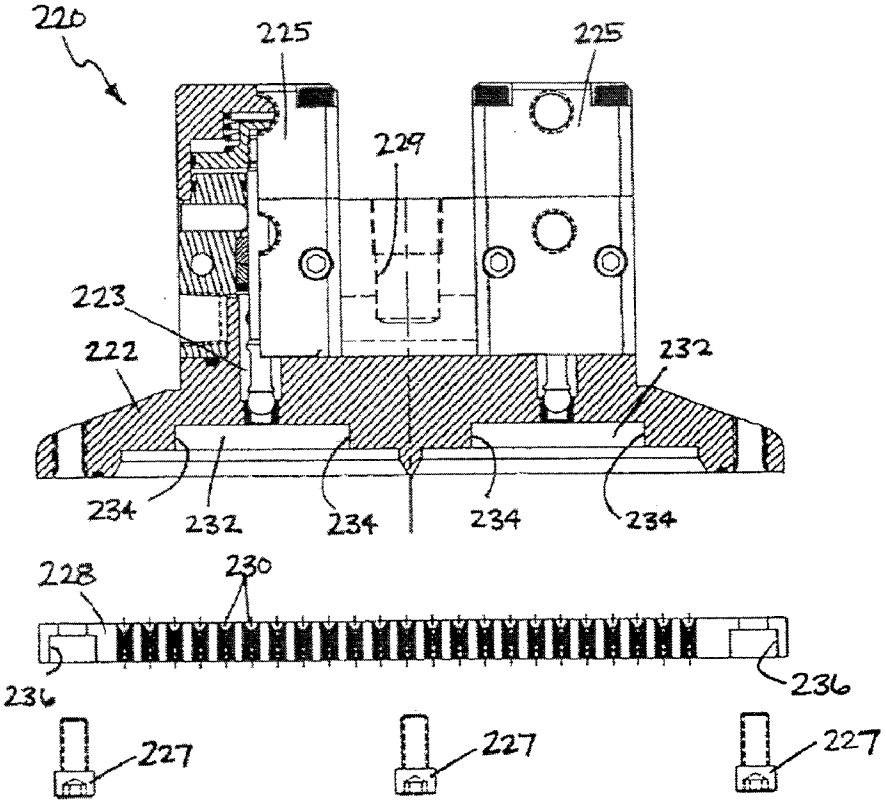
FIG. 13 is a cross-sectional side view of the multiple orifice applicator of FIG. 12.
Figure 12:
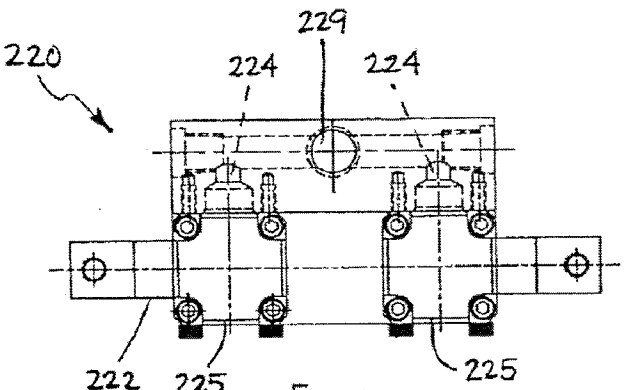
FIG. 12 is a top view of a multiple orifice applicator according to another embodiment of the present invention.
Figure 14:
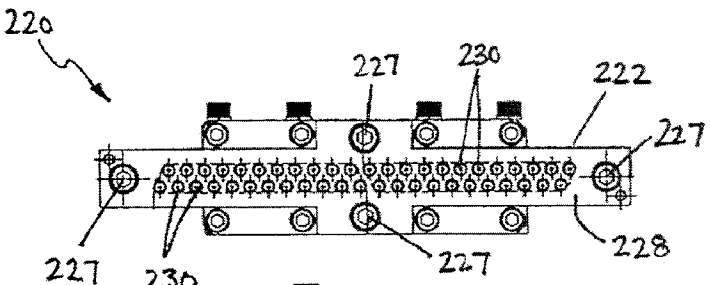
FIG. 14 is a bottom view of the multiple orifice applicator of FIG. 12.

Referring to FIGS. 12-14, a multiple orifice applicator 220 according to yet another embodiment of the present invention is shown in detail. Applicator 220 includes an applicator body 222, at least two integrated valves 225, an applicator plate 228 and bolts 227 that pass through applicator plate 228.

FIGS. 12 and 13 illustrate a top view and a cross-sectional view, respectively, of the multiple orifice applicator 220, wherein like elements of FIGS. 12 and 13 are identified by like numerals. As shown in FIG. 12, integrated valves 225 each include an inlet port 224 through which fluid material from the metering system enters the applicator 220. Inlet ports 224 are in fluid communication with a common inlet duct 229, which links inlet ports 224 with heat exchanger 16 of FIG. 1A. Although the applicator 220 is illustrated in FIGS. 12-14 as having two integrated valves 225, it will be appreciated that applicator 220 may include more than two integrated valves 225 depending on the nature of the application.

Applicator body 222 also includes dispersing chambers 232, which correspond in number to the number of integrated valves 225 and are in fluid communication with inlet ports 224. Valve actuators 223, which can be selectively opened and closed, are positioned between each inlet port 224 and a corresponding dispersing chamber 232. Each dispersing chamber 232 preferably includes terraced shoulders 234, which gradually increase the width and volume of the dispersing chambers 232. Optionally, the applicator body 222 may include temperature-conditioning ports (none shown), the function and structure of which have been previously described above.

FIG. 14 illustrates a bottom view of the multiple orifice applicator 220. As shown in FIG. 14, applicator plate 228 includes a plurality of orifices 230 through which fluid material passing through dispersing chambers 232 is dispensed. When applicator plate 228 is installed onto applicator body 222, bolts 227 are passed through applicator plate holes 236, into applicator body 222. In this way, applicator plate 228 is secured to applicator body 222. Optionally, applicator 220 may include a retaining plate (denoted as element 29 in FIG. 4) that is secured over applicator plate 228, as described above. Variations of the applicator as shown in FIGS. 4A and 4B can be used with this embodiment of the applicator 220 as well.

Outlet orifices 230 are preferably arranged in applicator plate 228 such that the outlet orifices dispense a substantially continuous band of fluid material. Accordingly, the outlet orifices 230 that correspond to one dispersing chamber 232 continue without substantial interruption from the outlet orifices 230 that correspond to the adjacent dispersing chamber. As shown in FIG. 14, applicator plate 228 includes two staggered offset adjacent rows of round outlet orifices 230. This configuration allows the dispensed fluid material to overlap one another without sacrificing structural integrity of the device. Alternatively, as shown in the embodiment illustrated in FIG. 6, applicator plate 228 may include two rows of elongated rectangular outlet orifices 30. Further, many other patterns and shapes of outlet orifices 230 may be employed, depending on the particular application. While the outlet orifices 230 may be formed simply by machining orifices in the applicator plate 228, orifice inserts made from an abrasive-resistant material, such as carbide, may also be used as described above.

Figure 15:
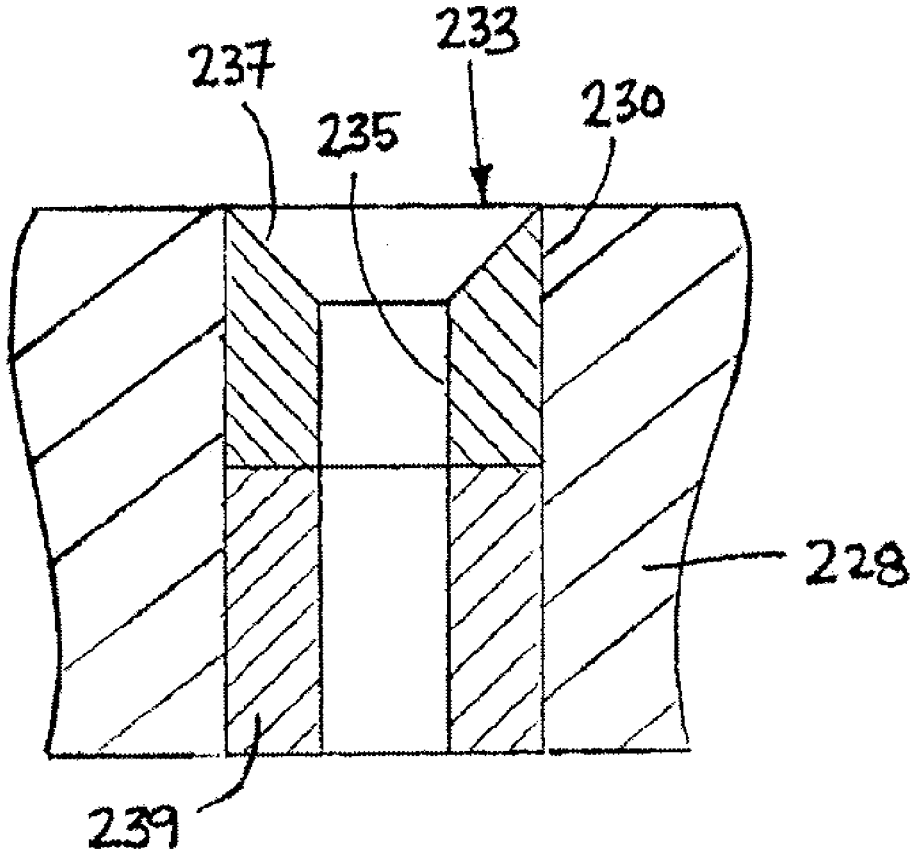
FIG. 15 is a cross-sectional view of a backing member that may be optionally employed in each of the orifices shown in FIGS. 13 and 14.

Referring to FIG. 15, the inlet of each orifice 230 may optionally include a backing member 233 having a passage 235 there through. The inlet to passage 235 includes a funnel-shaped chamfered lead in 237 that tapers into the remaining portion of passage 235. Backing member 233 reduces the amount of dead space that allows material 43 to dry out and potentially plug the orifice. Backing member 233 may be used independently or in cooperation with an abrasive-resistant material, such as carbide, which is generally depicted as element 239 in FIG. 15. Backing member 233 is also compatible for use with orifices 30 in applicator 20.

During operation of multiple orifice applicator 220, fluid material is caused to flow from the dispensing system into each inlet port 224 through inlet duct 229. In response to a control signal, each valve actuator 223 opens to permit fluid material to flow into a corresponding dispersing chamber 232. Each integrated valve 225 may incorporate desirable features, such as a spring back-up to close if air supply pressure is lost and divorced fluid and pneumatic chambers. The integrated valve 225 is effective to stop the fluid material from dripping from the applicator 220 when the valve is closed. The terraced shoulders 234 of dispersing chamber 232 allow the flow of fluid material entering the inlet ports 224 to disperse and spread out as the fluid material descends in the dispersing chambers 232. When the fluid reaches the bottom of each dispersing chamber 232, the fluid material is dispensed through the plurality of orifices 230 onto the work piece 106 (of FIG. 1A).

Figure 9:
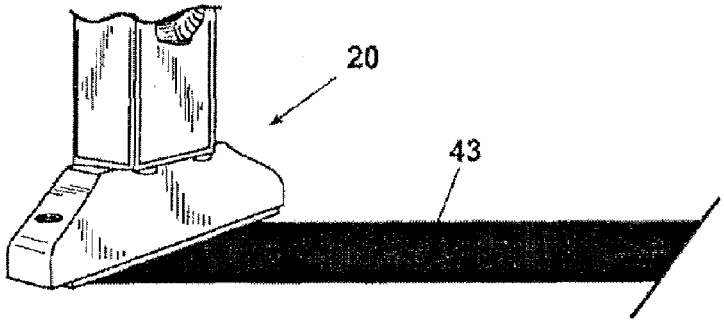
FIG. 9 is a perspective view of a multiple orifice applicator, wherein the multiple distinct rows of fluid material are blended and merged together without rotating the subject applicator.

As described above, the shape and positioning of the outlet orifices 230 can be implemented either so that staggered offset adjacent rows of material blend together to create a continuous band of material 43, as shown in FIG. 9, or maintain discrete rows, depending on the application. Additionally, one of valve actuators 223 may be closed while the other valve actuator 223 remains open to reduce the width of material dispensed. The ability to selectively open and close either of valve actuators 223 provides flexibility in dispensing the material to maneuver around obstacles, such as bolts or holes, on the work piece as well as to provide maximum flexibility to generate complex shapes and patterns of dispensed material. This feature is especially useful when applicator 220 includes a plurality of valve actuators 225, which can be selectively controlled to vary the width and spacing of the dispensed material.

Figure 16:
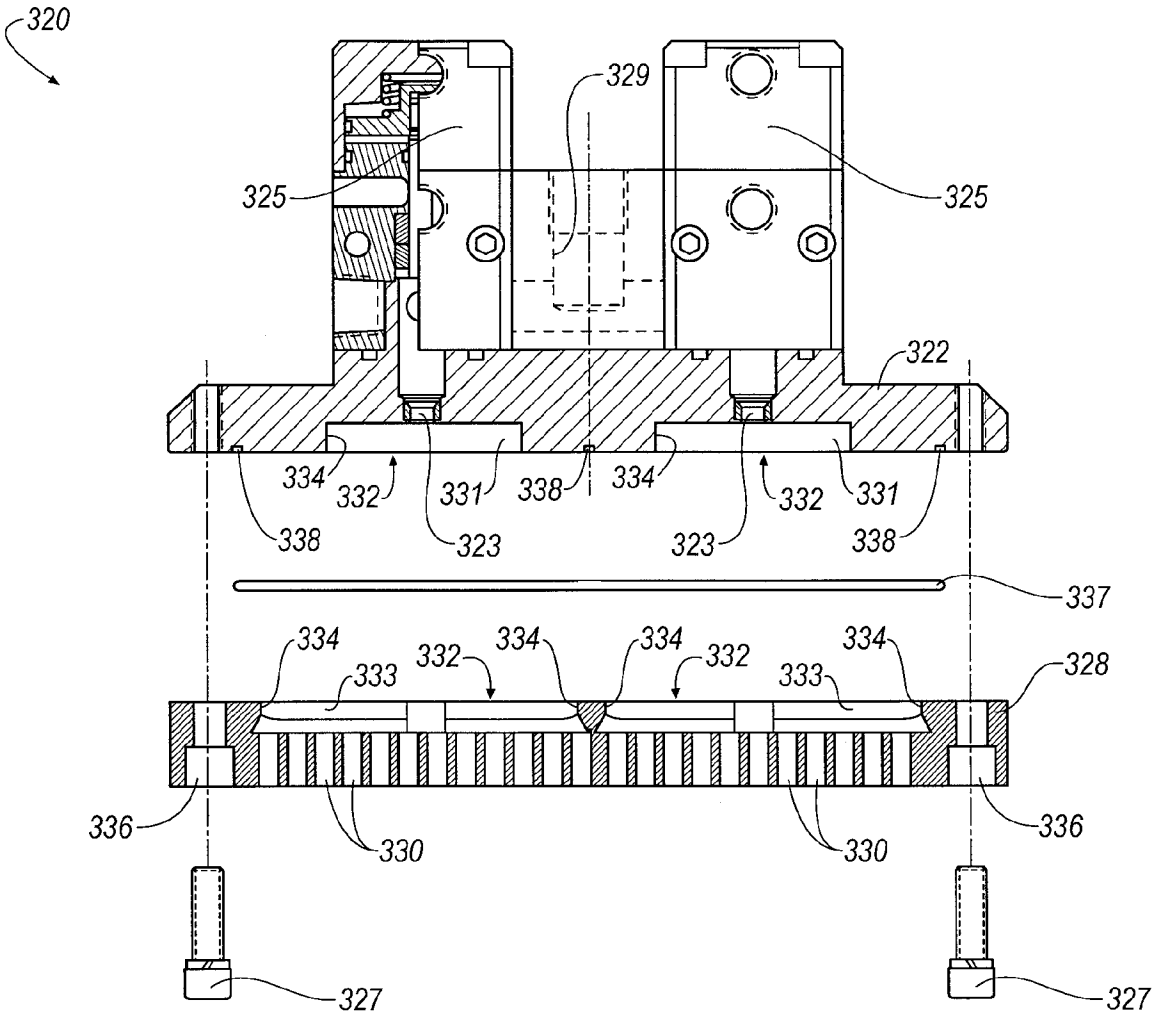
FIG. 16 is a cross-sectional side view of a multiple orifice applicator according to yet another embodiment of the present invention.
Figure 17:
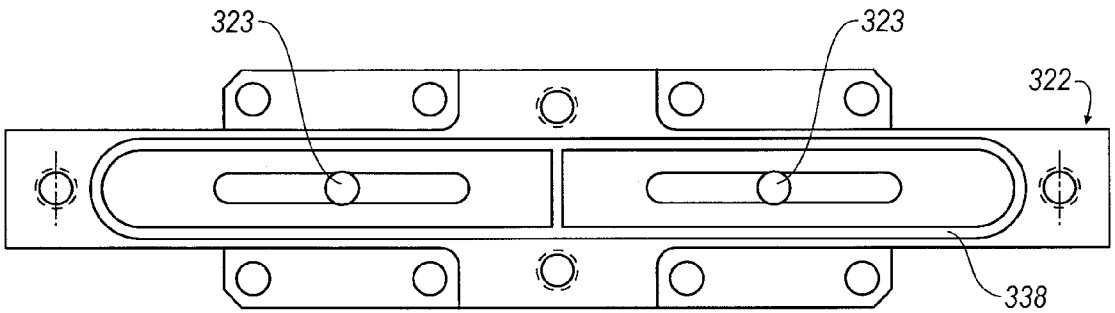
FIG. 17 is a bottom view of an applicator body of the multiple orifice applicator of FIG. 16.
Figure 18:
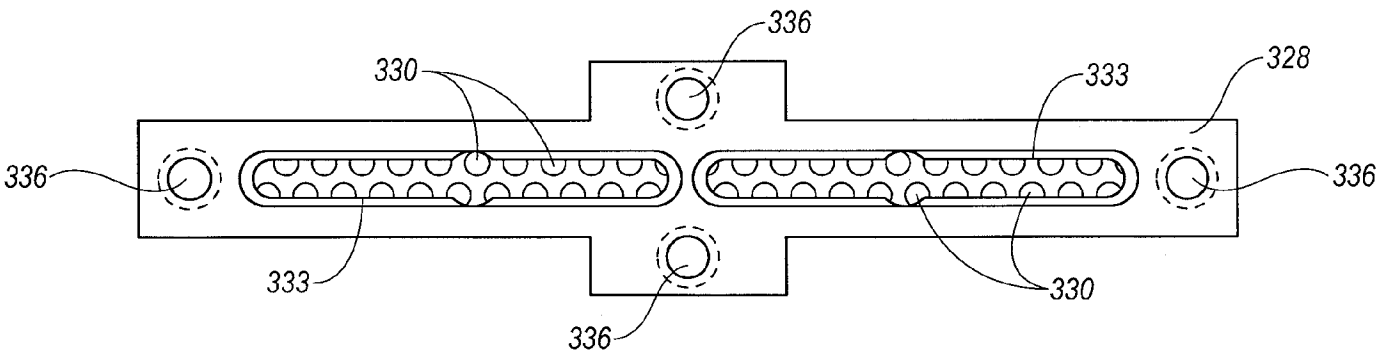
FIG. 18 is a top view of an applicator plate of the multiple orifice applicator of FIG. 16.

Referring to FIGS. 16-18, a multiple orifice applicator 320 according to yet another embodiment of the present invention is shown in detail. As shown, applicator 320 includes an applicator body 322, two integrated valves 325, an applicator plate 328 and bolts 327 that pass through applicator plate 328 into applicator body 322.

FIG. 16 illustrates a cross-sectional view of the multiple orifice applicator 320. Integrated valves 325 each include an inlet port (not shown) through which fluid material from the metering system enters the applicator 320. The inlet ports are in fluid communication with a common inlet duct 329, which links the inlet ports with heat exchanger 16 of FIG. 1A. Although the applicator 320 as illustrated in FIG. 16 has two integrated valves 325, it will be appreciated that applicator 320 may include more or less than two integrated valves 325 depending on the nature of the application.

In contrast to the embodiment illustrated in FIGS. 12-14, dispersing chambers 332 of the present embodiment are at least partially disposed within applicator plate 328. As seen in FIG. 16, the dispersing chambers 332 are divided such that a first portion 331 of the dispersing chambers 332 is received in the applicator body 322 while a second portion 333 of the dispersing chambers 332 is received in the applicator plate 328. Alternatively, each dispersing chamber 332 may be fully disposed within the applicator plate 328. Positioning at least the second portion 333 of the dispersing chambers 332 within the applicator plate 328 minimizes fluid leakage between the chambers 332 and between the applicator body 322 and the applicator plate 328.

Dispersing chambers 332 correspond in number to the number of integrated valves 325 and are in fluid communication with the inlet ports. As can be appreciated the illustrated embodiment shows two dispersing chambers 332, however, more or less chambers 332 are contemplated by the present invention. Further, each portion 331, 333 of the dispersing chambers 332 includes shoulders 334. The shoulders 334 are preferably terraced, which gradually increase the width and volume of the dispersing chambers 332. As seen in FIG. 16, the shoulders 334 are preferably terraced or angled outwardly to increase the width of the second portions 333. During operation of the applicator 320 the increased width facilitates communication of fluid from the first portions 331 of the dispersing chambers 332 through the second portions 333 to each of a plurality of orifices 330 in the applicator plate 328.

Disposed within the applicator body 322 are valve actuators 323 that can be selectively opened and closed. The valve actuators 323 are positioned between each inlet port and a corresponding dispersing chamber 332. Optionally, the applicator body 322 may include temperature-conditioning ports (not shown), the function and structure of which have been previously described above.

The multiple orifice applicator 320 of the embodiment of FIG. 16 also includes a seal 337 disposed generally about the dispersing chambers 332. Seal 337 is typically elastomeric and may be what is commonly known in the art as an o-ring. However, seal 337 may be of any material capable of forming a barrier to minimize leakage of fluid out of and between the two dispersing chambers 332 of the disclosed embodiment. Further, and especially when only one dispersing chamber 332 is employed in applicator plate 328, seal 337 functions to prevent fluid from leaking between the applicator body 322 and the applicator plate 328.

FIG. 17 illustrates a bottom view of the applicator body 322 of the embodiment of FIG. 16. A groove 338 is disposed within applicator body 322. Groove 338 receives seal 337 such that the seal 337 is at least partially recessed within applicator body 322. Positioning at least a portion 333 of the dispersing chambers 332 within applicator plate 328 permits applicator body 322 to accommodate seal 337. Specifically, the second portions 333 of the dispersing chambers 332 are generally wider than the first portions 331 due to the terraced shoulders 334. Accordingly, the second portions 333 are typically positioned closer together and do not provide the necessary space to accommodate the seal 337. The first portions 331 are generally narrower and hence have the space therebetween for accommodating the seal 337.

FIG. 18 illustrates a top view of the applicator plate 328. As shown in FIG. 18, applicator plate 328 includes the plurality of orifices 330 through which fluid material passing through dispersing chambers 332 is dispensed. When applicator plate 328 is installed onto applicator body 322, bolts 327 are passed through applicator plate holes 336 into applicator body 322. In this way, applicator plate 328 is secured to applicator body 322. Optionally, applicator 320 may include a retaining plate (denoted as element 29 in FIG. 4) that is secured over applicator plate 328, as described above. Variations of the applicator as shown in FIGS. 4A and 4B can also be used with this embodiment of the applicator 320 as well.

The operation of multiple orifice applicator 320 is similar to operation with respect to previously described applicators 20 and 220. Further, the shape of outlet orifices 330 and dispensing patterns of the applicator 320 are as flexible as described with applicator 220 having the two dispersing chambers 232. The applicator 320 and outlet orifices 330 of the present embodiment may also incorporate the backing member 233 illustrated in FIG. 15 and described above. Further, all other features such as controllers for valve actuators 23, locating dowels 26, retaining plate 29, temperature conditioning ports 19 and detachable applicator plate 28 previously described with respect to applicators 20, 220, 420 and 520 are also contemplated by the present embodiment of applicator 320.

Additionally, after the material 43 is applied to the work piece, applicator 20 may be at least partially inserted into a fluid bath, such as water, so that orifices 30 are submerged in the fluid. Submerging orifices 30 in a fluid pre-vents material 43 from drying out and restricting the flow of material 43 through orifices 30. The step of inserting the applicator into a fluid bath is also applicable to applicators 220, 320, 420 and 520.

The use of the multiple orifice applicator 20, 220, 320, 420 and 520 in connection with a metering and dispensing system for dispensing fluid materials provides several advantages over known prior art methods. For example, the multiple orifice applicators 20, 220, 320, 420 and 520 facilitate the creation of relatively wide bands of fluid materials in a single pass of the applicator while also offering maximum flexibility to generate the creation of complex dispensed material shapes and patterns. Further, the thickness of the applied material is more constant compared to other methods. Moreover, the multiple orifice applicators 20, 220, 320, 420 and 520 do not experience the "overspray" problems associated with swirling and spraying techniques described above. Another advantage is that the use of the integrated valve 25, 225 at a position in the fluid path relatively close to the dispersing chamber 32, 232 increases the responsiveness of the system when beginning to dispense fluid material and when stopping the application of fluid material, thus facilitating precise starts of fluid flow and minimizing undesirable dripping of material at the end of an application cycle. Yet another advantage of the multiple orifice applicator 20 is that the connecting dowels 26 provide a convenient way to locate the applicator plate 28 relative to the applicator body 22, and retaining plate 29 provides a convenient method of installing and uninstalling different applicator plates 28. Thus, applicator plates can be easily and quickly changed, which facilitates quick and efficient changeover without significant downtime for the system. Yet another advantage of the multiple orifice applicators 20, 220, 320, 420 and 520 is that they provide an effective alternative to using relatively expensive pre-die-cut melt pads. Instead of maintaining an inventory of different sized melt pads and manually applying them to various work pieces, the disclosed system (using the multiple orifice applicator) can be used to create a variety of different sizes of fluid material bands on a work piece during the manufacturing process, plus the end user can purchase the fluid material in large bulk containers to manufacture any size pattern. Thus, the need to inventory different melt pads is eliminated. Finally, the multiple orifice applicators 20, 220, 320, 420 and 520 do not have any additional moving parts—like the swirling devices have—that require additional maintenance and repair.

The preferred embodiments of the present invention have been described hereinabove. However, a person skilled in the art will recognize that the present invention can be used in a variety of different forms. Therefore, the following claims should be studied to determine the true scope and content of the invention.

The invention claimed is:

1. A multiple orifice applicator for applying a fluid material to a work piece, comprising:

an applicator body having an inlet port;

a detachable applicator plate coupled to said applicator body, said applicator plate having a plurality of outlet orifices configured to dispense fluid material onto the work piece;

at least two dispersing chambers providing a fluid flow path between said inlet port and at least two or more of said plurality of outlet orifices, wherein the cross-sectional area of said at least two dispersing chambers proximate said inlet port is smaller than the cross-sectional area of said at least two dispersing chambers proximate said outlet orifices, wherein said at least two dispersing chambers are partially disposed within said applicator plate and partially disposed in said applicator body; and a wall in said applicator plate that separates said at least two dispersing chambers, said wall having a top end and a bottom end that is narrower than said top end, a sealing member contacting said top end of said wall and said bottom end of said wall being proximate said outlet orifices of said applicator plate.

2. The multiple orifice applicator of claim 1, wherein said applicator body includes a groove around said at least two dispersing chambers, and said sealing member at least partially disposed in said groove and contacting said applicator plate.

3. The multiple orifice applicator of claim 1, wherein said applicator body includes a groove between said at least two dispersing chambers, and said sealing member at least partially disposed in said groove and contacting said applicator plate.

4. The multiple orifice applicator of claim 1, wherein said bottom end of said wall has an end tip that is narrower than a distance between said outlet orifices.

5. The multiple orifice applicator of claim 1, wherein said applicator body includes a groove extending around and between said at least two dispersing chambers, and said sealing member at least partially disposed in said groove and contacting said applicator plate.

6. The multiple orifice applicator of claim 5, wherein said sealing member is an elastomeric member.

7. The multiple orifice applicator of claim 1, wherein said at least one dispersing chambers includes at least one terraced shoulder.

8. A system for applying fluid material to a work piece, comprising:

a source of fluid material;

a multiple orifice applicator in fluid communication with said source of fluid material, said multiple orifice applicator comprising:

an applicator body having an inlet port;

a detachable applicator plate coupled to said applicator body, said applicator plate having a plurality of outlet orifices configured to dispense fluid material onto the work piece;

at least two dispersing chambers providing a fluid flow path between said inlet port and at least two or more of said plurality of outlet orifices, wherein the cross-sectional area of said at least two dispersing chambers proximate said inlet port is smaller than the cross-sectional area of said at least two dispersing chambers proximate said outlet orifices, wherein said at least two dispersing chambers are partially disposed within said applicator plate and partially disposed in said applicator body, a wall in said applicator plate that separates said at least two dispersing chambers, said wall having a top end and a bottom end that is narrower than said top end, a sealing member contacting said top end of said wall and said bottom end of said wall being proximate said outlet orifices of said applicator plate; and a mechanism for controlling relative positioning of said multiple orifice applicator and the work piece.

9. A multiple orifice applicator for applying a fluid material to a work piece, comprising:

an applicator body having an inlet port;

a detachable applicator plate coupled to said applicator body, said applicator plate having a plurality of outlet orifices configured to dispense fluid material onto the work piece;

at least two dispersing chambers providing a fluid flow path between said inlet port and at least two or more of said plurality of outlet orifices, wherein said at least two dispersing chambers are partially disposed within said applicator plate and partially disposed in said applicator body; and a wall in said applicator plate that separates said at least two dispersing chambers, said wall having a top end and a bottom end that is narrower than said top end, a sealing member contacting said top end of said wall and said bottom end of said wall being proximate said outlet orifices of said applicator plate.

10. The multiple orifice applicator of claim 9, wherein said applicator body includes a groove around said at least two dispersing chambers, and said sealing member at least partially disposed in said groove and contacting said applicator plate.

11. The multiple orifice applicator of claim 9, wherein said applicator body includes a groove between said at least two dispersing chambers, and said sealing member at least partially disposed in said groove and contacting said applicator plate.

12. The multiple orifice applicator of claim 9, wherein said bottom end of said wall has an end tip that is narrower than a distance between said outlet orifices.

13. The multiple orifice applicator of claim 9, wherein said applicator body includes a groove extending around and between said at least two dispersing chambers, and said sealing member at least partially disposed in said groove and contacting said applicator plate.

14. The multiple orifice applicator of claim 13, wherein said sealing member is an elastomeric member.

15. The multiple orifice applicator of claim 9, wherein said at least two dispersing chambers includes at least one terraced shoulder.

* * * * *